United States Patent [19]

Joyce

[11] Patent Number: 4,787,525

[45] Date of Patent: Nov. 29, 1988

[54] CHILD-RESISTANT CLOSURES

[76] Inventor: Michael Joyce, 287 Smoke Rise Rd., Kinnelon, N.J. 07405

[21] Appl. No.: 137,504

[22] Filed: Dec. 23, 1987

[51] Int. Cl.[4] ..... B65D 55/02; B65D 85/56; A61J 1/00

[52] U.S. Cl. ..... 215/201; 215/237; 222/153

[58] Field of Search ..... 215/201, 216, 237, 235; 222/153, 546, 556

[56] References Cited

U.S. PATENT DOCUMENTS

| | | | |
|---|---|---|---|
| 3,556,331 | 1/1971 | Towns . | |
| 3,584,760 | 6/1971 | Grinker . | |
| 3,604,585 | 9/1971 | Towns . | |
| 3,773,203 | 11/1973 | Grimaldi et al. | 215/201 |
| 3,826,394 | 7/1974 | Stull . | |
| 4,047,495 | 9/1977 | O'Brian . | |
| 4,209,100 | 6/1980 | Uhlig | 215/237 |
| 4,371,095 | 2/1983 | Montgomery et al. . | |
| 4,378,073 | 3/1983 | Luker | 215/237 |
| 4,420,089 | 12/1983 | Walker et al. . | |
| 4,424,910 | 1/1984 | Heinol . | |
| 4,444,326 | 4/1984 | Musel . | |
| 4,487,324 | 12/1984 | Ostrowsky . | |
| 4,533,058 | 8/1985 | Uhlig . | |
| 4,555,038 | 11/1985 | Nagel, Jr. . | |
| 4,580,687 | 4/1986 | Lewis . | |
| 4,629,081 | 12/1986 | McLaren | 215/237 |
| 4,696,408 | 9/1987 | Dubach . | |
| 4,718,567 | 1/1988 | La Range | 215/216 |
| 4,723,669 | 2/1988 | Barriac | 215/237 |

FOREIGN PATENT DOCUMENTS

| | | |
|---|---|---|
| 2158048 | 11/1985 | United Kingdom . |

*Primary Examiner*—George T. Hall

*Attorney, Agent, or Firm*—Lerner, David, Littenberg, Krumholz & Mentlik

[57] ABSTRACT

A child resistant flip-top closure. The base of the closure is provided with an upwardly projecting rib which lies alongside the lid or movable element of the closure when the lid is in the closed position. The rib impedes access to the lid and hence opening of the closure. The rib includes a resilient portion which can be manually engaged and flexed outwardly, away from the lid to provide access to the lid. The resilient portion of the rib may be curved inwardly along its top edge.

22 Claims, 2 Drawing Sheets

CHILD-RESISTANT CLOSURES

The present invention relates to childresistant closures and to other child-resistant devices.

Hinged closures, also referred to as "flip-top" closures incorporate a base and a lid. The base is adapted to engage a closure, and incorporates a top surface having an opening. The lid is attached to the base by a connection such as a hinge so that the lid is movable, relative to the base, between closed and open positions. In the closed position, the lid overlies the top surface of the base and occludes the opening, whereas in the open position the lid is remote from the opening. When the base is secured to the mouth of a container, the lid controls access to the contents of the container. The base, lid and hinge may be molded as elements of a single, integral piece of plastic material.

Various attempts have been made to provide child-resistant flip-top closures having features which impede opening of the lid by a child but which permit opening of the lid by an adult. Such child-resistant features are useful where the closure is employed on a container holding a toxic or otherwise hazardous material. For some materials, a child-resistant closure is required by law.

British patent application No. 2 158 048 A discloses a flip-top cap having a ring movably mounted to the base. In the normal position of the ring, the ring protrudes upwardly from the base and surrounds the lid when the lid is in the closed position. Thus, the periphery of the lid is inaccessible, and a child cannot engage the lid to move it from the closed position to the open position. An adult can move the ring downwardly relative to the base so as to gain access to the lid, but a child normally cannot accomplish the required twisting and sliding motion. The closure shown in U.S. Pat. No. 3,584,760, utilizes a guard ring rotatable relative to the base with a separate spring for biasing the guard ring. These features add cost and complexity to such a device.

Others have attempted to make a satisfactory child resistant flip-top closure having all of its elements molded in a single piece. As disclosed in U.S. Pat. Nos. 3,556,331 and 3,604,585, the lid may have an elongated, rectangular shape, whereas the base may have a narrow slot in its top surface. When the lid is in its closed position, it is recessed within the slot in the top surface of the base. The parts are dimensioned so as to provide only a very narrow opening at the end of the lid remote from the hinge so that the lid can be opened only by an adult capable of engaging a tool or fingernail within this narrow opening. U.S. Pat. No. 4,047,495 describes a child resistant closure wherein the base is provided with an upstanding rim or wall around its top surface, such that the lid is recessed within this rim when in the closed position. The base is also provided with a projection adjacent the middle of the top surface so that the underside of the lid bears on this projection. The lid can be opened by forcing its rearward portion, adjacent the hinge, downwardly, towards the base. The projection on the base acts as a fulcrum, causing the forward portion of the lid to lift upwardly and hence to project above the rim on the base. In this condition, the forward portion of the lid can be engaged and pulled upwardly, away from the base so as to swing the lid to its open position. U.S. Pat. No. 4,371,095 utilizes a similar arrangement. U.S. Pat. No. 4,533,058 employs an elongated, straplike lid received in an elongated slot extending entirely across the top surface of the base from the rear or hinge side to the front side. The base is provided with a cam surface such that when the distal portion of the straplike lid, remote from the hinge, is forced downwardly, the tip of the lid is forced outwardly at the front of the base. The outwardly projecting tip can be engaged and pulled upwardly.

U.S. Pat. No. 4,444,326 discloses a flip top closure having a base integral with the container body itself and incorporating a peripheral wall on the base which can be forced inwardly at one location so as to expose the underside of the lid for manual engagement. U.S. Pat. No. 4,209,100 shows a further child resistant closure having a lid which is recessed in the top surface of the base when the lid is in the closed position. The base has an upstanding peripheral wall abutting the forward portion of the lid, remote from the hinge. This peripheral wall is arranged so that it can be forced inwardly, towards the lid. The lid and peripheral wall are provided with cam surfaces so that inward motion of the peripheral wall will move the lid upwardly, away from its closed position to a partially open position. In this partially open position, the lid protrudes above the top surface of the base and hence is accessible for manual engagement by the user.

U.S. Pat. No. 4,696,408 illustrates a flip-top closure having features intended as tamper evident rather than child resistant. Thus a "safety band" is detachably mounted to the base and projects upwardly adjacent the forward edge thereof so as to block access to the distal portion of the lid, remote from the hinge. When the lid is in the closed position, there is a narrow slot between the lid and safety band. The safety band can be detached by engaging a finger or fingernail or the like between the lid and the band and pulling the band to break the lugs connecting the band to the base. This leaves the lid permanently exposed and accessible for opening and closing.

A further child resistant closure is disclosed in U.S. Pat. No. 3,826,394. The closure of the U.S. Pat. No. 3,826,394 includes a lid having a projection at the distal extremity of the lid, remote from the hinge. The projection extends forwardly adjacent the forward edge of the base when the lid is in the closed position. A pair of guard members mounted on the forward edge of the base define a vertically extensive slot. The projection on the distal end of the lid is disposed in the slot when the cap is in the closed position. In some embodiments of the U.S. Pat. No. 3,826,394 closure, such as those shown in FIGS. 4–6 and 7–9 thereof, a flat, platelike tab extends between the guard members or projects upwardly in the slot between the guard members. The tab confronts the distal extremity of the projection on the lid. To open the lid, the tab is flexed forwardly and hence away from the lid and a finger or fingernail is inserted under the projection.

Each of the aforementioned closures leaves something to be desired with respect to resistance to opening by a child, ease of opening by an adult, manufacturing cost, appearance and other factors. Despite the extensive efforts made by the art heretofore towards development of a truly satisfactory childresistant flip top closure, there have been needs heretofore for still further improvements.

SUMMARY OF THE INVENTION

The present invention addresses those needs. One aspect of the present invention provides a closure including a base having a top surface facing generally in an upward direction and having an opening in the top surface. The closure also includes a lid and means for mounting the lid to the base for movement between a closed position and an open position. In the closed position, the lid overlies the top surface and occludes the opening whereas in the open position the lid does not occlude the opening. The mounting means are arranged so that the lid moves generally upwardly, away from the top surface upon initial movement of the lid from the closed position towards the open position. Preferably, the closure is a flip-top closure, and hence the connecting means includes hinge means for connecting the lid to the body for pivotal movement substantially around a predetermined axis.

The closure most preferably includes an elongated, curvilinear rib protruding upwardly from the body and extending at least partially around the opening. The rib has an inward face facing towards the opening and an outward face facing away from the opening. When the lid is in the closed position, the rib is disposed alongside the lid with the inward face of the rib facing towards the lid. The rib thus impedes access to the lid. The rib preferably includes a resilient portion and two substantially rigid portions continuous with the resilient portion and extending from the opposite ends thereof. Appropriate means are provided for permitting manual engagement of the resilient portion of the rib so that the resilient portion of the rib can be flexed outwardly, away from the lid to expose the lid for manual engagement. The lid and the rib may define a slot therebetween, such slot being open at the top, so that the resilient portion of a rib can be engaged by inserting a finger or fingernail into the slot. Thus, the closure can be opened readily by an adult user. However, a young child normally cannot perform the required operations to open the closure.

The closure preferably includes means for preventing application of an upward force to the lid upon inward flexure of the resilient rib portion. Thus, the closure cannot be opened by forcing the resilient portion of the rib inwardly, toward the lid. The closure thus resists children's attempts to open it by biting or other "brute force" attacks. Most preferably, that region of the inward face of the rib which engages the lid open inward flexure of the resilient portion faces downwardly upon such flexure. Thus, inward flexure of the resilient portion of the rib will apply a downward force, rather than an upward force, to the lid.

The resilient portion of the rib has an upper edge, remote from the base. Most preferably, this upper edge is arcuate and convex in the inward direction. Thus, in its normal, undistorted condition, the upper edge of the resilient portion bows inwardly, towards the lid. The lower edge of the resilient portion of the rib, adjacent the base, preferably is connected to the base along substantially the entire extent of the resilient portion. The lower edge of the resilient portion desirably has less of a convex, inward curvature than does the upper edge. Thus, the lower edge may have convex inward curvature on a larger radius than the upper edge, may be substantially in a stright line (zero curvature), or even have a slight concave, outward curvature, i.e., a negative inward curvature. In any event, from the lower edge of the resilient portion the convex, inward curvature of the resilient portion preferably increases progressively up to the top edge. The rib configuration according to this aspect of the invention permits flexure of the upper edge of the rib over a substantial range of motion and hence facilitates access to the lid by an authorized, adult user. Moreover, it provides forceful and reliable resilience, while limiting the maximum stress in the rib to a reasonable value. Preferably, the lid has an identation which is aligned with the inwardly bowed resilient portion when the lid is in the closed position, so that the indentation and the resilient portion define a curved portion of the slot. This curved portion of the slot is well adapted to receive a fingernail and hence facilitates engagement of the resilient portion and opening of the closure.

The entire closure, including the base, lid, hinge and rib, is formed as a single integral piece of plastic material, as by injection molding. The features which provide child resistance in the preferred closures according to this aspect of the present invention can be provided at only minimal cost. The rib, including the inwardly bowed resilient portion, can be molded integrally with the remainder of the closure utilizing simple and economical molding techniques and molds.

These and other objects, features and advantages of the present invention will be more readily apparent from the detailed description of the preferred embodiment set forth below, taken in conjunction with the accompanying drawings.

DETAILED DESCRIPTION OF THE PREFERRED EMBODIMENTS

Figure 4:
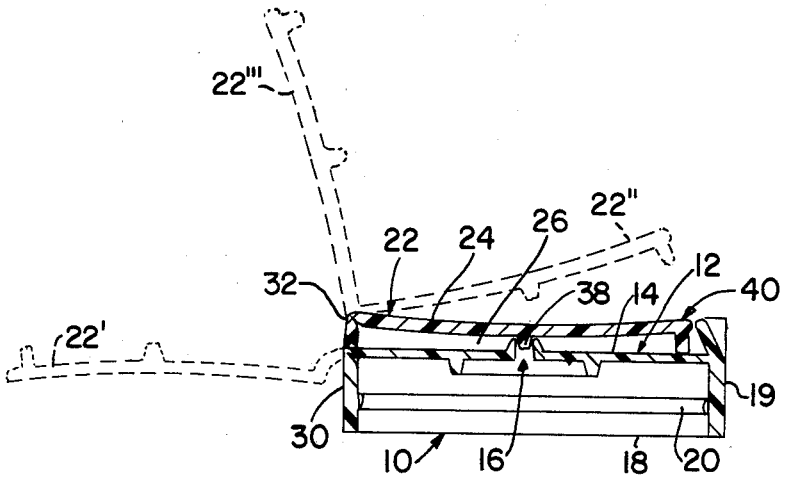
FIG. 4 is a sectional view taken along line 4—4 in FIG. 2.
Figure 5:
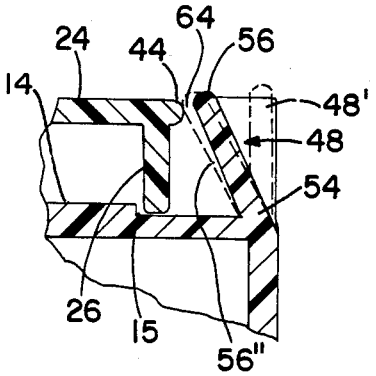
FIG. 5 is fragmentary, sectional view on an enlarged scale of the area indicated in FIG. 4.
Figure 6:
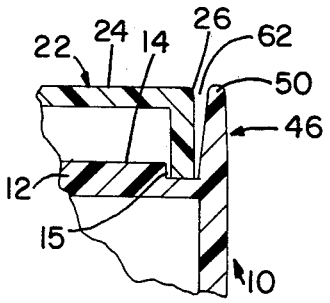
FIG. 6 is a fragmentary, sectional view on an enlarged scale taken along line 6—6 in FIG. 2.

A closure in accordance with one embodiment of the present invention includes a generally cylindrical base 10 having a top wall 12 defining a top surface 14 facing generally in the upward direction, towards the top of the sheet in FIG. 4. The direction "upwardly" as used herein should be understood as referring to this upward direction defined by the top surface of the base. The base also has an opening 16 extending through the top wall 12 and hence through top surface 14 adjacent the center of the top surface and a skirt i8 extending downwardly from top wall 12 at the periphery of the top wall. Skirt 18 is provided with features such as a locking ring 20 for fastening base 10 to a container such as a bottle so that the base cannot be readily removed from the container and so that opening 16 is aligned with the mouth or opening of the container. Skirt 18 has an outwardly-facing surface 19 along one portion of the base, referred to herein as the forward portion of the base. Top wall 12 defines a ridge 15 (FIGS. 5 and 6) facing outwardly, away from opening 16 adjacent to the periphery of top surface 14.

The closure also includes a lid 22 generally in the form of a shallow cup. Lid 22 includes a top wall 24 and a peripheral wall 26 extending generally perpendicular to top wall 24 around the periphery thereof. Lid 22 is connected to base 10 by a flexible hinge 28, the lid being formed integrally with the hinge and the base. Hinge 28 desirably is a "over center" or "snap action" hinge of the type disclosed in U.S. Pat. No. 4,503,991, and in U.S. patent application Ser. No. 904,868, filed on Sept. 8, 1986, the disclosures of which regarding such snap action hinge are incorporated herein by reference thereto.

Hinge 28 joins a rearward portion 30 of base 10 and a proximal portion 32 of lid 22 so that lid 22 can pivot with respect to base 10 between the closed position illustrated in solid lines in the figures and a fully open position 22' depicted in broken lines in FIG. 4. In such pivoting movement, the lid swings relative to the base about a predetermined pivot axis 36 adjacent the rearward portion 30 of the base and the proximal portion 32 of the lid. In the initial movement of the lid away from its closed position, to a partially open position 22', the lid moves generally upwardly, away from top surace 14 of the base. In the closed position lid 22 overlies the central portion of top surface 14 of the base, surrounding opening 16, and the lid occludes the opening. As illustrated, lid 22 is provided with a plug 38 projecting from the underside of top wall 22, the plug being received and frictionally engaged within opening 16 when the lid is in the closed position.

When lid 22 is in the closed position, the peripheral wall 26 of the lid extends substantially upwardly from top surface 14 of the base. When the lid is in the closed position, the lower edge of the lid peripheral wall 26, remote from top wall 24, bears on the top surface 14 of base 10, and the inwardly facing surface of the peripheral wall is engaged with the vertical ridge 15 in top wall 12. Also, in the closed position, the distal portion 40 of lid 22, remote from pivot axis 36, projects forwardly with respect to the base and is disposed adjacent the forward portion 19 of base 10. Lid 22 has an indentation 42 at its distal extremity. At indentation 42, the peripheral wall 26 of the base is bowed proximally, i.e., towards the proximal portion 32 of the lid and hence towards pivot axis 36.

Figure 2:
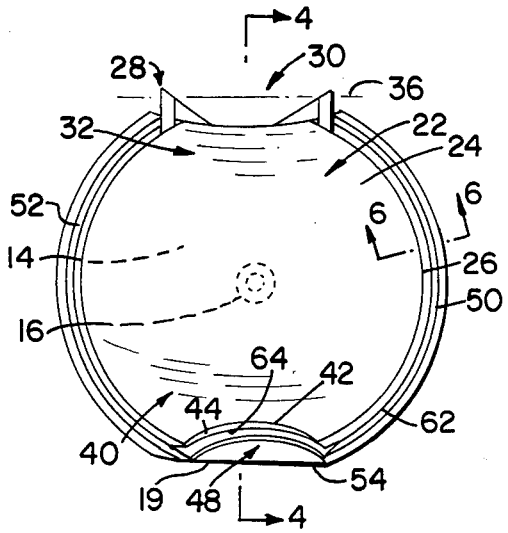
FIG. 2 is a top view of the closure depicted in FIG. 1.

Also at indentation 42, a ridge 44 (FIGS. 2 and 5) projects distally or away from pivot axis 36 adjacent the top of peripheral wall 26.

An elongated, curvilinear rib 46 projects upwardly from base 10 adjacent the periphery of top surface 14. Rib 46 includes a resilient portion 48 at the forward portion 19 of base 10 and a pair of rigid portions 50 and 52 continuous with resilient portion 48 at both ends thereof. Rigid portions 50 and 52 extend rearwardly from the resilient portion, towards pivot axis 36. As seen from the top of the closure (FIG. 2) rigid portions 50 and 52 are substantially arcuate and convex in the outward direction. Thus, the rigid portions 50 and 52 of rib 46 are generally in the form of arcs centered on 16. Adjacent the forward portion 19 of base 10, each of the rigid portions 50 and 52 is of substantially uniform height or vertical extent upward from the top surface 14. However, the height of each rigid portion 50 and 52 diminishes progressively adjacent the rearward portion 30 of the base. Rigid portions 50 and 52 thus cooperatively define an opening adjacent the rearward portion of the base. This opening provides clearance for movement of lid 22 as the lid swings about pivot axis 36 in its opening motion.

The resilient portion 48 of rib 46 is of lesser thickness than the rigid portions 50 and 52. Resilient portion 48 has a lower edge 54 connected to base 10 and merging therewith along substantially the entire length of the resilient portion. Lower edge 54 is substantially straight, and is aligned with the flat portion 19 at the forward extremity of base 10. The upper edge 56 of the resilient portion is curved so that this edge is convex in the inward direction. Thus, upper edge 56 bows inwardly towards opening 16 and hence rearwardly, towards pivot axis 36. Resilient portion 48 of the rib has a convex, inward bow or curvature which increases progressively from the lower edge 54 (no curvature or possibly even a slight outward curvature) to the upper edge 56 (maximum inward curvature). Resilient portion 48 joins rigid portions 50 and 52 at lines of joinder 58 and 60 respectively, these lines of joinder or borders between the rigid and flexible portions extending substantially vertically, i.e., upwardly and downwardly. Portions 50 and 52 thus provide substantially rigid support for the ends of the resilient rib portion along the entire upward-to-downward extent of the resilient portion. In particular, the resilient portion is supported at its ends adjacent top edge 56. In the normal undistorted state of the resilient portion 48 the height or upward extent of the resilient portion from top surface 14 is substantially the same as the height of the forward regions of the rigid portions 50 and 52. The top edge 56 of the resilient portion is thus substantially continuous with the top edges of the rigid portions.

One side of the rib faces inwardly, toward the opening, whereas the opposite side of the rib faces outwardly, away from the opening. With respect to the forwardmost portions of the rib, including resilient portion 48, the rearward face of the rib faces inwardly whereas the forward face faces outwardly. The rib defines a pocket around the opening 16. The central portion of base top surface 14 adjacent the opening forms the bottom surface of the pocket. When the lid 22 is in the closed position depicted in solid lines, the lid is received in the pocket, with the peripheral wall 26 of the lid confronting the inward face of the rib. Thus, the peripheral wall of the lid and the rib cooperatively define a narrow groove or slot 62 therebetween, this slot being open at the top. Also in the closed position, the indentation 42 in the lid is aligned with the resilient portion 48 of the rib, so that the ridge 44 at the top of peripheral wall 26 in the indentation 42 and the inwardly bowed upper edge 56 of the resilient rib portion cooperatively define a narrow, arcuate opening or slot portion 64. The lid is releasably held in this closed position by the frictional engagement of prong 38 in opening 16, which tends to resist movement of the lid from the closed position. Also, hinge 28 tends to hold the lid in its closed position.

Figure 1:
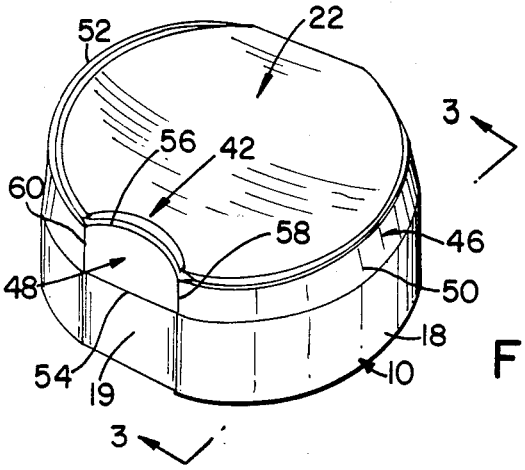
FIG. 1 is a schematic perspective view of a closure in accordance with one embodiment of the present invention.
Figure 3:
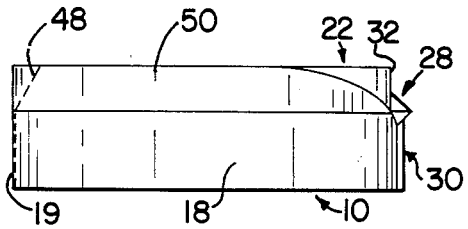
FIG. 3 is a elevational view taken along line 3—3 in FIG. 1.

As best appreciated with reference to FIGS. 1 and 3, the rib projects upwardly alongside the distal portion of the lid, remote from the hinge 28 and pivot axis 36 when the lid is in the closed position. Thus, the rib substantially impedes access to the distal portion of the lid. Although the proximal portion of the lid, adjacent pivot axis 36 can be engaged by a finger, it is extremely difficult to move the lid from its closed position by urging the proximal portion upwardly. Thus, it is essentially impossible to move the lid from the closed position without engaging the distal portion of the lid.

The distal portion of the lid can be exposed by inserting a finger or fingernail into the opening 64 between the top edge 56 of the resilient rib portion and the indentation 44 of the lid, and then urging the top edge forwardly and hence outwardly, away from the lid. This action brings the resilient portion 48 to the outwardly flexed condition indicated in broken lines at 48' in FIG. 5. Because the opening 64 is arcuate, its configuration substantially matches the configuration of the fingernail, and hence it is easy to insert a finger or fingernail into the opening 64. Once the resilient portion of the rib has been flexed outwardly, away from the lid, the distal extremity of the lid is exposed, and can be engaged by the fingers, preferably by the same finger applied to move the resilient portion. The ridge 44 (FIG. 5) on the lid facilitates engagement of the distal extremity of the lid. Thus, the lid can be grasped and swung readily from the closed position towards the open position 22', against the resistance provided by frictionally engaged plug 38 and against the resistance of hinge 28. In the initial portion of this movement away from the closed position, the lid moves generally upwardly, through the partially open position 22''. Once the lid has passed a midpoint position 22''', the snap action of hinge 28 pulls the lid towards its full open position 22'. The hinge retains the lid in its full open position until the lid is deliberately moved back towards the closed position, past position 22'''. If the lid is moved to position 22 prime prime, close to its closed position, the snap action of the hinge will tend to bring the lid back towards its fully closed position.

The lid cannot be displaced from its fully closed position by forcing the resilient portion 48 of the rib inwardly, towards the lid. As shown best in FIG. 5, the resilient portion 48 of the rib is slightly higher than the immediately adjacent portion of lid 22. The resilient portion thus extends upwardly beyond the adjacent portion of the lid when the rib is in its normal, undistorted condition. If the resilient portion of the rib is forced inwardly, towards the lid, that portion of the rib's inward face adjacent upper edge 56 will be brought into abutment against the lid. However, in this condition the inward face of the rib faces downwardly, towards top surface 14. Therefore, any force applied by the rib to the lid will have a significant downward component. This tends to force the lid more firmly into its closed position, rather than to open the lid.

The entire closure is desirably injection molded as a single, integral piece of a plastic material, most preferably a polyolefin such as high density polyethylene. The precise dimensions and configuration of the closure will vary with the application. By way of example, however, a closure having a base about 33 mm in diameter may have a rib about 7.8 mm to about 8 mm high, the rigid portions of the rib being about 0.6 to about 0.65 mm thick. In this closure, the resilient portion of the rib may be about 0.3 mm to about 0.35 mm thick. The radius of curvature of the upper edge 56 of the resilient rib portion, as seen in top view, may be about 10 mm to about 10.5 mm. The opening or slit 64 adjacent the resilient portion may be about 0.4 mm to about 0.5 mm wide.

As will be appreciated, numerous variations and combinations of the features described about can be utilized without departing from the present invention as defined in the claims. Merely by way of example, the orientation of the opening in the top surface is of no consequence. Thus, the top surface may have a bulge test or nozzle projecting upwardly therefrom, and the opening in the top surface may be directed laterally, parallel to the top surface may be directed laterally, parallel to the top surface rather than upwardly and downwardly as illustrated. Also, the particular features provided to hold the base onto the container will vary with the application. Thus, various known forms of ribs, screw threads, detents and the like may be provided to match substantially any container configuration. Indeed, the base of the closure can be fused to the container or formed integrally therewith. The rib on the top surface can be provided with more than one resilient portion. Also, the resilient portion or portions of the rib need not be disposed at the forward extremity of the base, but instead can be disposed at other locations remote from the pivot axis.

Indeed, the present invention can be applied to closures which do not incorporate a hinge. Thus, the rib can be provided on a closure where the lid is entirely removed from the base upon opening and to closures where the lid is permanently connected to the base for upward and downward sliding movement. For example, the principles of the invention may be applied to so-called "valve" type closures where upward sliding movement of the lid relative to the base acts to open a port in the top surface. Further, the present invention may be applied to items other than closures. Thus, a rib having a resilient portion as discussed above may be used to limit access to a movable element device such as a switch, valve or the like. Such limited access may be desirable to make the device child-resistant or to prevent accidental operation of the device. In such an arrangement, the rib may be mounted on a fixed portion of the device and project therefrom so that the rib is disposed alongside of a movable portion of the device such as a knob, button or the like and hence impedes access thereto. Upon outward flexure of the resilient portion of the rib, the movable portion of the device is exposed for manual engagement. The rib need not include rigid portions as such. Thus, the access-limiting functions of the rigid portions of the rib may be performed by other structures on the fixed portion of the device. Desirably, however, any such other structures provide substantially rigid support for the resilient portion of the rib at the ends thereof.

As these and other variations and combinations of the features described above can be utilized, the foregoing description of the preferred embodiments should be taken by way of illustration rather than by way of limitation of the invention.

I claim:

1. A closure comprising:

(a) a base having a top surface facing generally in an upward direction and an opening in said top surface;

(b) a lid;

(c) means for mounting said lid to said closure for movement between a closed position wherein said lid overlies said top surface and occludes said opening and an open position wherein said lid does not occlude said opening, so that said lid moves upwardly away from said top surface in movement from said closed position toward said open position;

(d) an elongated, curvilinear rib protruding upwardly from said base and extending at least partially around said opening, said rib having an inward face facing toward said opening and an outward face facing away from said opening, said rib being disposed alongside said lid with said inward face facing toward said lid so that said rib impedes access to said lid when said lid is in said closed position, said rib including a resilient portion and two substantially rigid portions continuous with said resilient portion and extending from opposite ends thereof; and (e) means for permitting manual engagement of said resilient portion of said rib to thereby permit outward flexure of said resilient portion away from said lid so as to expose said lid for manual engagement.

2. A closure as claimed in claim 1 wherein said means for mounting includes hinge means for connecting said lid to said base for pivotal movement substantially around a predetermined axis, said resilient portion of said rib being disposed remote from said axis.

3. A closure as claimed in claim 2 wherein said base has forward and rearward portions, said top surface extending between said forward and rearward portions, said resilient portion of said rib being disposed adjacent the forward portion of said base, said lid having proximal and distal portions, and said predetermined axis being disposed adjacent said proximal portion of said lid and said rearward portion of said base.

4. A closure as claimed in claim 3 wherein said substantially rigid portions of said rib extend rearwardly from said resilient portion, whereby said substantially rigid portions of said rib are disposed alongside portions of said lid between said proximal and distal portions when said lid is in said closed position.

5. A closure as claimed in claim 1 wherein an upper edge of said resilient portion of said rib remote from said base is arcuate and convex in the inward direction.

6. A closure as claimed in claim 5 wherein said resilient portion of said rib has a lower edge adjacent said base, said lower edge of said resilient portion having less convex, inward curvature than said upper edge.

7. A closure as claimed in claim 6 wherein said lower edge of said resilient portion of said rib is connected to said base along substantially the entire extent of said resilient portion.

8. A closure as claimed in claim 7 wherein the convex inward curvature of said resilient portion of said rib increases progressively from said lower edge to said upper edge.

9. A closure as claimed in claim 6 wherein said lower edge of said resilient portion of said rib is substantially straight.

10. A closure as claimed in claim 5 wherein said rib and said lid define a slot therebetween, said slot being at least partially open in the upward direction and adapted to receive a finger or fingernail, said means for permitting manual engagement including said slot.

11. A closure as claimed in claim 10 wherein said lid has an indentation therein substantially conforming to the convex inward curvature of said upper edge of said resilient portion of said rib, said indentation and said resilient portion of said rib being aligned with one another when said lid is in said closed position.

12. A closure as claimed in claim 1 further comprising means for preventing application of an upward force to said lid by inward flexure of said resilient portion of said rib.

13. A closure as claimed in claim 1 wherein said inward face of said resilient portion of said rib includes an abutment region, said abutment region engaging said lid upon inward flexure of said resilient portion when said lid is in said closed position, said abutment region facing downwardly upon such engagement whereby said lid cannot be forced upwardly by inward flexure of said resilient portion of said rib.

14. A closure as claimed in claim 1 wherein said resilient portion of said rib extends above the adjacent portion of said lid when said lid is in said closed position.

15. A closure as claimed in claim 14 wherein said lid has a ridge thereon, said ridge being remote from said base and projecting outwardly toward said resilient portion of said rib when said lid is in said closed position.

16. A closure as claimed in claim 1 formed entirely as a single, integral piece of plastic material.

17. A closure as claimed in claim 1 further comprising means for resisting movement of said lid from said closed position toward said open position.

18. A device having a fixed element, a movable portion juxtaposed with said fixed element when said movable element is in one position thereof, and a rib projecting in an upward direction from said fixed element so that said rib is disposed alongside said movable element and impedes access thereto when said movable element is in said one position, said rib having an inward face facing towards said movable element and an outward face facing away from said movable element, said rib including a resilient portion, an upper edge of said resilient portion of said rib remote from said fixed element being arcuate and convex in the inward direction.

19. A device as claimed in claim 18 wherein said resilient portion of said rib has a lower edge adjacent said fixed element, said lower edge of said resilient portion having less convex, inward curvature than said upper edge.

20. A device as claimed in claim 19 wherein said lower edge of said resilient portion of said rib is connected to said fixed element along substantially the entire extent of said resilient portion.

21. A device as claimed in claim 20 wherein the convex inward curvature of said resilient portion of said rib increases progressively from said lower edge to said upper edge.

22. A device as claimed in claim 19 wherein said lower edge of said resilient portion is substantially straight.

* * * * *